US005322492A

United States Patent [19]

Pearson

[11] Patent Number: 5,322,492

[45] Date of Patent: Jun. 21, 1994

[54] EXERCISE APPARATUS

[76] Inventor: Bob L. Pearson, 1996 Bonnie Dr. #5, Memphis, Tenn. 38116

[21] Appl. No.: 130,709

[22] Filed: Oct. 4, 1993

[51] Int. Cl.[5] ..... A63B 21/04

[52] U.S. Cl. ..... 482/129; 482/121; 482/123; 482/130

[58] Field of Search ..... 482/116, 121-130, 482/133-138, 142

[56] References Cited

U.S. PATENT DOCUMENTS

| | | | |
|---|---|---|---|
| 1,561,979 | 11/1925 | Gore | 482/130 |
| 3,428,312 | 2/1969 | Machen | 482/130 X |
| 3,567,219 | 3/1971 | Foster | 482/130 |
| 3,640,529 | 2/1972 | Kane | 482/130 X |
| 3,985,354 | 10/1976 | Schulkin | 482/130 X |
| 3,992,004 | 11/1976 | Feron et al. | 482/130 X |
| 4,170,351 | 10/1979 | Olbey et al. | 482/130 |
| 4,494,662 | 1/1985 | Clymer | 482/130 X |
| 4,921,247 | 5/1990 | Sterling | 482/130 X |
| 5,072,932 | 12/1991 | Johnson | 482/129 X |

FOREIGN PATENT DOCUMENTS

| | | | |
|---|---|---|---|
| 176915 | 10/1906 | Fed. Rep. of Germany | 482/129 |
| 1335308 | 9/1987 | U.S.S.R. | 482/130 |
| 2107999 | 5/1983 | United Kingdom | 482/130 |

*Primary Examiner*—Robert Bahr
*Attorney, Agent, or Firm*—E. Michael Combs

[57] ABSTRACT

An exercise apparatus includes a reciprocating body reciprocatably mounted between spaced and parallel first and second guide plates having respective first and second slots, with the first and second slots arranged to slidably receive first and second U-shaped locks arranged to lock and secure the reciprocating body relative to a central lock plate, that in turn is reciprocatably mounted within a second tube received within a first tube within the reciprocating body, such that the first and second tubes include respective first and second springs positioned on opposed sides of the central lock plate.

5 Claims, 4 Drawing Sheets

EXERCISE APPARATUS

BACKGROUND OF THE INVENTION.

1. Field of the Invention

The field of invention relates to exercise apparatus, and more particularly pertains to a new and improved exercise apparatus arranged to permit torso exercise of an individual.

2. Description of the Prior Art

Exercise apparatus of various types have been indicated in the prior art and exemplified by the U.S. Pat. Nos. 4,231,568; 5,129,873; 3,893,667; 4,750,740; and 5,072,932.

The instant invention attempts to overcome deficiencies of the prior art by providing for an exercise apparatus arranged for ease of use as well effectiveness in construction and in this respect, the present invention substantially fulfills this need to permit ease of exercising of an individual's torso.

SUMMARY OF THE INVENTION

In view of the foregoing disadvantages inherent in the known types of exercise apparatus now present in the prior art, the present invention provides an exercise apparatus including means to mount in a pivotal and torsional relationship a reciprocating body relative to a second guide tube received within a first guide tube in the body. As such, the general purpose of the present invention, which will be described subsequently in greater detail, is to provide a new and improved exercise apparatus which has all the advantages of the prior art exercise apparatus and none of the disadvantages.

To attain this, the present invention provides an exercise apparatus including a reciprocating body reciprocatably mounted between spaced and parallel first and second guide plates having respective first and second slots, with the first and second slots arranged to slidably receive first and second U-shaped locks arranged to lock and secure the reciprocating body relative to a central lock plate, that in turn is reciprocatably mounted within a second tube received within a first tube within the reciprocating body, such that the first and second tubes include respective first and second springs positioned on opposed sides of the central lock plate.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved exercise apparatus which has all the advantages of the prior art exercise apparatus and none of the disadvantages.

It is another object of the present invention to provide a new and improved exercise apparatus which may be easily and efficiently manufactured and marketed.

It is a further object of the present invention to provide a new and improved exercise apparatus which is of a durable and reliable construction.

An even further object of the present invention is to provide a new and improved exercise apparatus which is susceptible of a low cost of manufacture with regard to both materials and labor, and which accordingly is then susceptible of low prices of sale to the consuming public, thereby making such exercise apparatus economically available to the buying public.

Still yet another object of the present invention is to provide a new and improved exercise apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
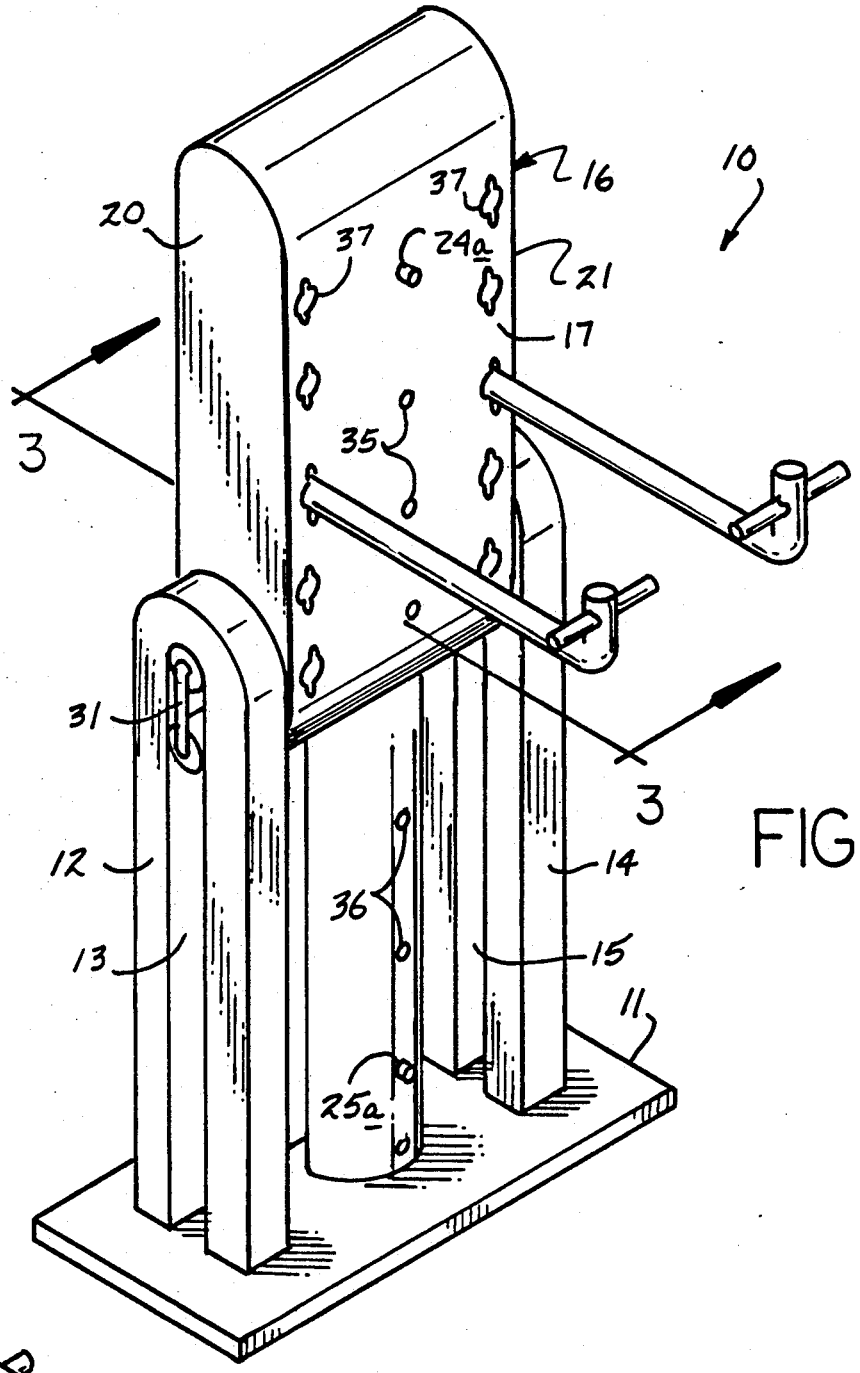
FIG. 1 is an isometric illustration of the invention.
Figure 2:
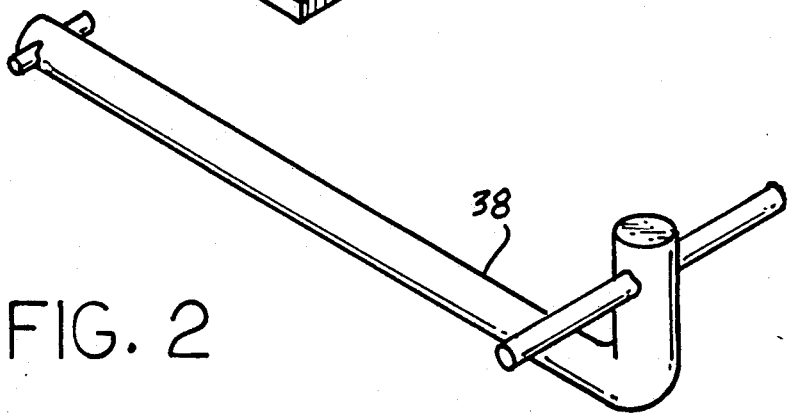
FIG. 2 is an isometric illustration of the arm members mounted within the reciprocating body.

With reference now to the drawings, and in particular to FIGS. 1 to 8 thereof, a new and improved exercise apparatus embodying the principles and concepts of the present invention and generally designated by the reference numeral 10 will be described.

Figure 3:
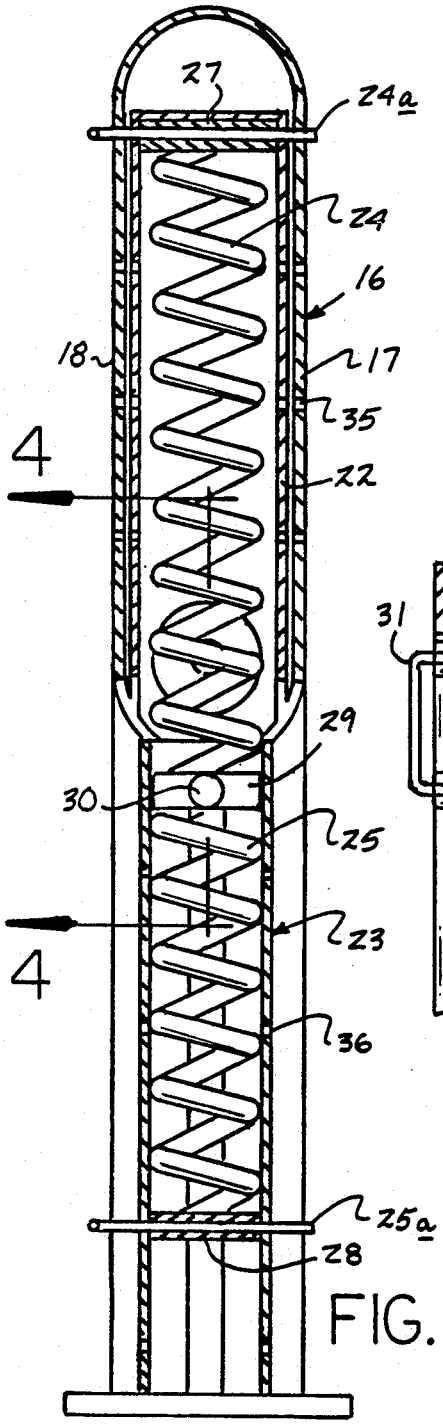
FIG. 3 is an orthographic view, taken along the lines 3—3 of FIG. 1 in the direction indicated by the arrows.
Figure 4:
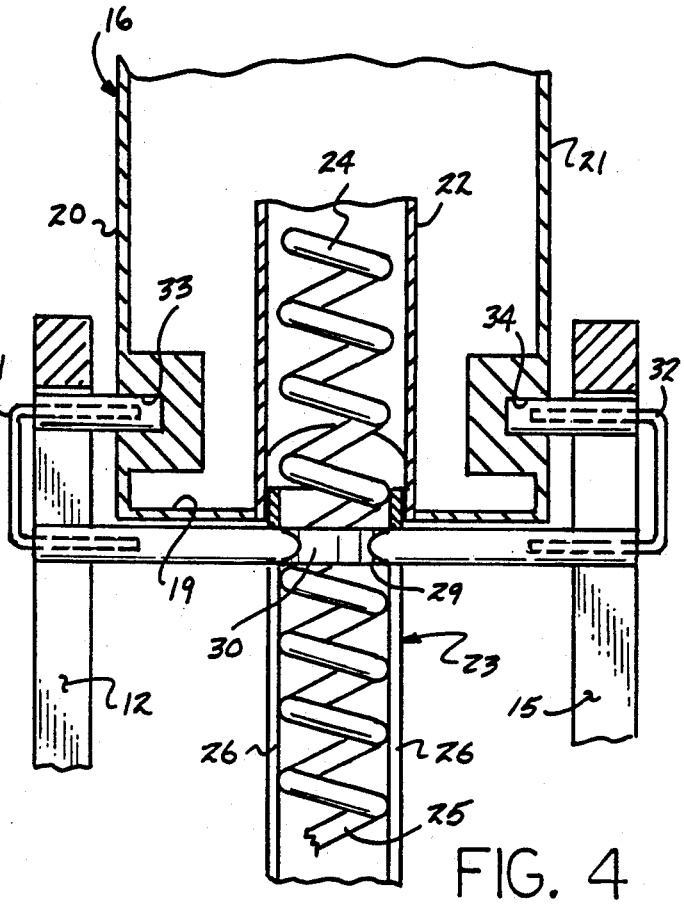
FIG. 4 is an orthographic view, taken along the lines 4—4 of FIG. 3 in the direction indicated by the arrows.

More specifically, the exercise apparatus 10 of the instant invention essentially comprises a base plate 11 having fixedly and orthogonally mounted thereto first and second guide plates 12 and 14 having respective first and second slots 13 and 15, with the slots arranged in a parallel coextensive relationship relative to one another, with the first and second guide plates arranged to reciprocatingly receive a reciprocating body 16 therebetween. The reciprocating body 16 includes spaced front and rear walls 17 and 18, a floor 19, as well as first and second side walls 20 and 21. A first guide tube 22 is fixedly mounted within the reciprocating body extending from the floor 19 medially thereof parallel between the first and second side walls 20 and 21. A second tube 23 is fixedly and orthogonally mounted relative to the base plate 11 extending medially between and parallel the first and second guide plates 12 and 14, with the second tube arranged for reception within the first tube, as indicated in FIG. 4, in a sliding inter-relationship, such that a first coil spring 24 mounted within the first tube 22 is aligned with a second coil spring 25 within the second tube, with a first lock pin 24*a* mounting an outermost end of the first coil spring 24 within the first tube, and a second lock pin 25*a* mounting an outermost end of the second coil spring within the second tube 23, as indicated in FIG. 3. A second tube slot 26 diametrically directed coextensively through the second tube is aligned with and in a facing relationship relative to the first and second slots 13 and 15, such that a central lock plate 29 mounted intermediate the first and second coil springs 24 and 25 securing the second coil springs includes a second lock plate bore 30 arranged to receive respective first and second U-shaped locks 31 and 32 that are also simultaneously received within first and second side wall bores 33 and 34 of the respective first and second side walls 20 and 21. It should be noted, as illustrated in FIG. 3 for example, that the first and second lock pins 24*a* and 25*a* are respectively and slidably received through respective first and second spring lock plates 27 and 28 mounting the outermost ends of the respective first and second coil springs 24 and 25, with the first and second lock pins arranged for selective reception within one of a row of first and second lock pin bores 35 and 36 directed respectively through the respective reciprocating body 16 and the second tube 23, as illustrated in FIG. 1, with the first and second lock pin bores 35 and 36 longitudinally aligned relative to one another to permit adjustment of tension of the first and second coil springs and their displacement relative to the central lock plate 29. A plurality of rows of arm receiving bores 37 are directed into the reciprocating body 16 through the front wall 17 to receive in a locking relationship L-shaped arms 38. In this manner, an individual may employ the L-shaped arms 38 for grasping to provide for leg lifts by lifting and lowering of the reciprocating body 16 against the tension of the springs, as the reciprocating body 16 is directed to project the first and second U-shaped locks 31 and 32 through the second tube slot 26 compressing the second spring 25 while tensioning the first coil spring 24.

Figure 5:
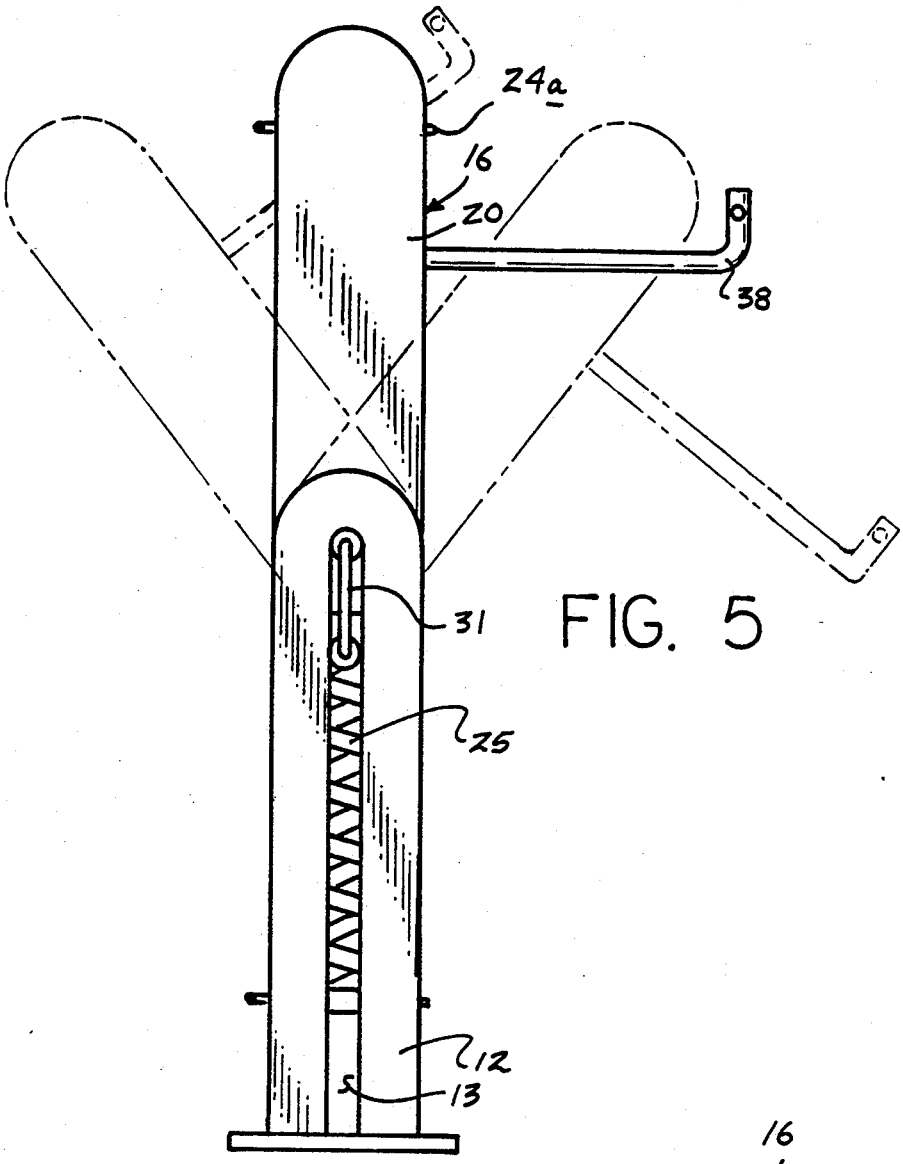
FIG. 5 is an orthographic side view of the body arranged for pivotal mounting relative to the spaced guide plates upon removal of the U-shaped lock structure.
Figure 6:
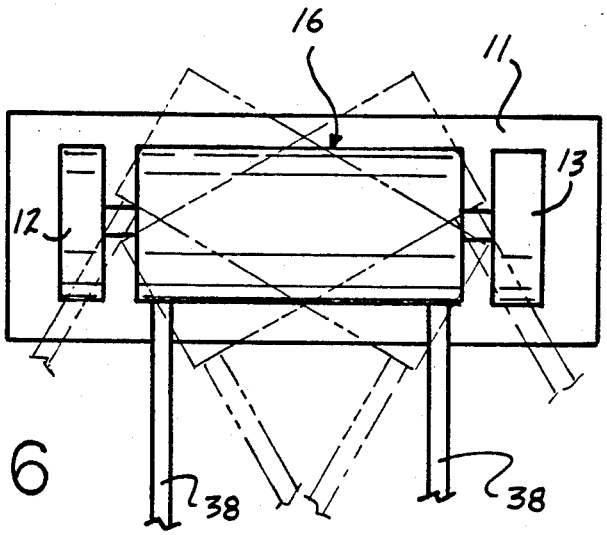
FIG. 6 is an orthographic top view of the construction indicating the torsional rotation permitted of the reciprocating body relative to the first and second guide plates.

The FIG. 5 indicates that upon removal of the first and second U-shaped pin locks 31 and 32, the reciprocating body 16 upon removing the first tube 22 from the second tube permits its pivoting between the first and second guide plates, while permitting the reception of the second tube 23 within the first tube 22 permitting rotation of the first guide tube 22 about the second guide tube 23, as well as reciprocating body 16 that is fixedly mounted to the first tube through the floor 19.

Figure 7:
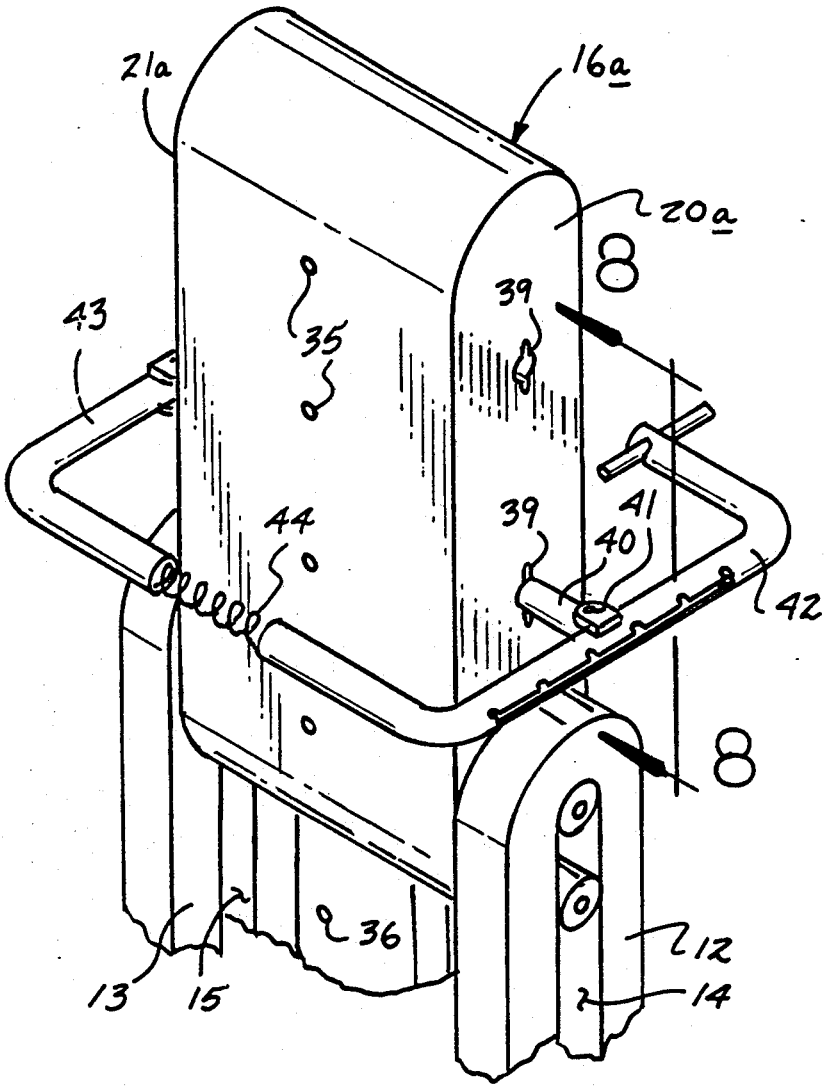
FIG. 7 is an isometric illustration of a modified reciprocating body arranged for mounting mirror image first and second U-shaped arms to the respective first and second side walls of the modified body.
Figure 8:
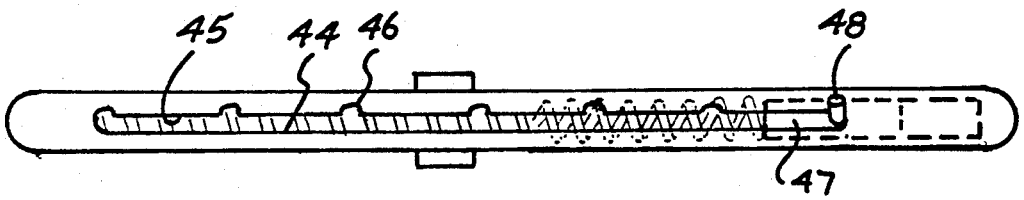
FIG. 8 is an orthographic view, taken along the lines 8—8 of FIG. 7 in the direction indicated by the arrows.

The FIGS. 7 and 8 indicate that a modified reciprocating body 16*a* is provided with modified first and second side walls 20*a* and 21*a* respectively, having respective rows of side wail arm receiving bores 39, each receiving a side wall arm 40, such as indicated in FIG. 7, with each side wall arm 40 having a pivot junction 41 pivotally mounting a first and second U-shaped arm 42 and 43 relative to the first and second modified bodies 20*a* and 21*a*. Within each of the first and second U-shaped arms 42 and 43 is an individual resistance spring 44 extending therethrough interconnecting the first and second U-shaped arms 42 and 43, such that each of the arms or at least one of said arms, as indicated in FIG. 8, includes an arm slot 45 having spaced arm slot recesses 46 to receive a slide block pin 48 of a slide block 47 permitting the compression of the resistance spring 44 upon projection of the slide block 47 through the arm slot 45 and locking the slide block pin 48 with one of the recesses 46. In this manner, an individual may employ the first and second U-shaped arms 42 and 43 for pivoting about the pivot junctions 41 of each arm 40 for permitting simultaneous grasping of the first and second U-shaped arms 42 and 43 by an individual and their pivoting to provide for such exercise such as chest exercise and the like.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. An exercise apparatus, comprising, a base plate, a first guide plate and a second guide plate fixedly and orthogonally mounted to the base plate, with the first guide plate and the second guide plate arranged in a parallel coextensive relationship, with the first guide plate having a first slot, the second guide plate having a second slot, with the first slot and the second slot arranged in a coextensive parallel relationship relative to one another, and a body reciprocatingly mounted between the first guide plate and the second guide plate between the first slot and the second slot, and the body having a front wall spaced from a rear wall, a floor, a first side wall spaced from a second side wall, with a first tube fixedly and orthogonally mounted to the floor extending medially between the first side wall and the second side wall within the body, and a second tube fixedly and orthogonally mounted to the base plate between the first guide plate and the second guide plate, with the second tube slidingly and coaxially received within the first tube, and a first spring mounted within the first tube, and a second spring mounted within the second tube, and a central lock plate positioned between the first spring and the second spring securing the first spring and the second spring, and a first U-shaped lock and a second U-shaped lock received through the first slot and the second slot respectively and into the central lock plate, with the first U-shaped lock and the second U-shaped lock simultaneously received within the first side wail and the second side wall, the second tube having a second tube slot directed coextensively of the second tube and aligned with the first slot and the second slot permitting sliding reception of the first U-shaped lock and the second U-shaped lock within the second tube slot.

2. An apparatus as set forth in claim 1 wherein the body includes a row of first lock pin bores, the second tube having a row of second lock pin bores coplanar with the first lock pin bores, with a first spring lock plate mounted to the first spring, and a first lock pin directed through the first spring lock plate and through one of said first lock pin bores, with a second spring lock plate mounted to the second spring, with a second lock pin directed through the second spring lock plate and through one of said second lock pin bores.

3. An apparatus as set forth in claim 2 including plural rows of arm receiving bores directed through the body through the front wall, with a plurality of L-shaped arms arranged for reception through a plurality of arm receiving bores of said plural rows of arm receiving bores.

4. An apparatus as set forth in claim 3 wherein additionally the first side wall and the second side wall each include a row of side wall bores, wherein a plurality of side wall arms are provided, with one side wall arm of said plurality of side wall arms received within the first side wall and a further side wall arm of said plurality of side wall arms is received within the second side wall, with the side walk and the further side wall arm each including a pivot junction, and a first U-shaped arm mounted to the side wall arm at the pivot junction of the side wall arm, and a second U-shaped arm mounted to the further side wall arm at the pivot junction of the further side wall arm, with a resistance spring directed throughout the first U-shaped arm and the second U-shaped arm.

5. An apparatus as set forth in claim 4 with a slide block mounted within the side wall arm, and the slide block having a pin, the side wall arm having an arm slot, the arm slot including a plurality of spaced recesses, wherein the pin is arranged for reception within one of the recesses.

* * * * *